US005707033A

United States Patent [19]

Holt et al.

[11] Patent Number: 5,707,033

[45] Date of Patent: Jan. 13, 1998

[54] ANTENNA MOUNTING APPARATUS

[76] Inventors: Robert J. Holt, 212 SW. 22nd Pl., Cape Coral, Fla. 33991-1352; Rodney G. Parrish, P.O. Box 1503, Cape Coral, Fla. 33910

[21] Appl. No.: 574,360

[22] Filed: Dec. 18, 1995

[51] Int. Cl.[6] ..... A47B 96/06

[52] U.S. Cl. ..... 248/225.11; 248/223.41; 343/882

[58] Field of Search ..... 248/220.21, 223.41, 248/225.11, 475.1, 489; 343/840, 880, 882

[56] References Cited

U.S. PATENT DOCUMENTS

| | | | |
|---|---|---|---|
| 1,286,376 | 12/1918 | Madsen | 248/225.11 X |
| 1,848,937 | 3/1932 | Coventry | 248/223.41 |
| 2,891,757 | 5/1959 | Lang | 248/225.11 |
| 3,822,049 | 7/1974 | Saunders | 248/225.11 X |
| 3,912,216 | 10/1975 | Gano | 248/475.1 X |
| 3,915,189 | 10/1975 | Holbrook et al. | 248/223.41 X |
| 4,389,133 | 6/1983 | Oberst | 248/225.11 X |
| 4,584,589 | 4/1986 | Bivins et al. | 343/882 |
| 4,613,135 | 9/1986 | Rush | 248/223.41 X |
| 5,026,016 | 6/1991 | Lisowski | 248/225.11 X |
| 5,080,238 | 1/1992 | Hochman | 248/224.61 X |
| 5,129,613 | 7/1992 | Lloyd et al. | 248/225.11 X |
| 5,356,104 | 10/1994 | Rosenberg et al. | 248/225.11 X |
| 5,526,010 | 6/1996 | Plunk | 343/882 |

FOREIGN PATENT DOCUMENTS

| | | | |
|---|---|---|---|
| 59-15308 | 1/1984 | Japan | 343/880 |

*Primary Examiner*—Ramon O. Ramirez
*Assistant Examiner*—Stephen S. Wentsler
*Attorney, Agent, or Firm*—William E. Noonan

[57] ABSTRACT

An apparatus is provided for mounting a receiving antenna to a separate and distinct supporting structure. The apparatus includes a bracket having a slot formed therein. The bracket is secured to the supporting structure. A portable mounting component includes an outer section to which the antenna is secured. An inner tongue section is connected to the outer section and is slidably insertible into the slot such that the mounting component is releasably interengaged with the bracket. There is a stop section attached to the tongue section. The stop section is engaged with the bracket proximate an entrance of the slot to limit the extent to which the tongue section is insertible into the slot.

16 Claims, 5 Drawing Sheets

ANTENNA MOUNTING APPARATUS

FIELD OF THE INVENTION

This invention relates to an antenna mounting apparatus and, more particularly, to an apparatus for mounting the receiving antenna of a satellite television system to various mobile and fixed structures such as motor homes, boats, houses, vans, dock pilings and other structures.

BACKGROUND OF THE INVENTION

Direct satellite television systems provide viewers with a wide and varied selection of viewing options. Recently, satellite-based television systems have become increasingly popular due to a drastic reduction in the size of the receiving antenna. Relatively compact antennae can now be attached to fixed locations, such as homes and office buildings, and to mobile structures, such as boats, vans and motor homes.

Conventional satellite mounting systems exhibit a number of disadvantages. Most feature a relatively permanent construction. After the antenna is installed, it cannot be easily relocated for better reception. In many structures, such as apartment buildings and condominiums, the antenna must be permanently mounted in an inconvenient or awkward location. Trees, surrounding buildings and other objects may interfere with clear reception. Additional problems are experienced by receiving antennae that are mounted to mobile vehicles. One popular conventional antenna available under the trademark WINEGARD(TM) employs a crank that raises the antenna when signal reception is desired. The crank lowers the antenna when the vehicle is in motion. This product is bulky and expensive. Even when the antenna is lowered, it can catch on trees, power lines and other surrounding structures. This can cause serious and even permanent damage to the antenna. Moreover, the antenna is not portable and cannot be readily moved to improve reception.

To date, virtually no portable antenna mounts are available for television satellite systems. One such supposedly portable conventional device has been offered under the trademark MTS 2000(TM). However, that system is unduly complicated and fairly expensive.

SUMMARY OF INVENTION

It is therefore an object of the present invention to provide an improved portable mounting system for a receiving antenna of the type used in satellite television systems.

It is a further object of this invention to provide a portable antenna mounting apparatus that permits a receiving antenna to be quickly and conveniently relocated and repositioned when needed so that improved signal reception is achieved.

It is a further object of this invention to provide a portable mounting system that permits a receiving antenna to be temporarily, yet securely attached to a wide variety of both fixed and mobile structures.

It is a further object of this invention to provide a portable antenna mounting system that permits an antenna to be quickly and conveniently mounted to either side of a motor home and which also permits the antenna to be repositioned on or removed entirely from the motor home, as required.

It is a further object of this invention to provide a portable antenna mounting system that employs a simplified and inexpensive construction.

It is a further object of this invention to provide a portable antenna mounting apparatus that is lightweight, and yet extremely rugged.

This invention features an apparatus for mounting a receiving antenna to a separate and distinct supporting structure. The apparatus includes a bracket having a slot formed therein. There are means for securing the bracket to the supporting structure. A portable mounting component includes an outer section that carries means for securing the receiving antenna to the outer section. An inner tongue section is connected to the outer section and is slidably insertible into the slot such that the mounting component is releasably interengaged with the bracket. A stop section is attached to the tongue section. The stop section is engaged with the bracket proximate an entrance of the slot to limit the extent to which the tongue section is insertible into the slot.

In a preferred embodiment, the slot extends substantially vertically and the entrance to the slot is formed at an upper end thereof. The means for securing may include at least one hole formed in the bracket and a complementary fastening element that is engageable with each such hole. The means for securing may also include a backing component that is engaged with the supporting structure such that the supporting structure is disposed between the bracket and the backing component. The means for securing may further include at least one aligned pair of complementary holes formed in the bracket and the backing member and fastening means that extend through the support structure and are interengaged with each such pair of aligned holes.

The mounting component may include an intermediate section, which interconnects the outer section and the tongue section. The bracket may have an opening formed therethrough into the slot. The opening may accommodate the intermediate section of the mounting component when the tongue section is inserted into the slot. The slot and the tongue section may include elongate, substantially flat configurations. The tongue section may include a leading end that has angled corners, which facilitate insertion of the tongue section into the slot.

The outer section may comprise a substantially flat plate. The slot may include a pair of elongate channels and the tongue section may have a pair of generally vertical side portions that are respectively received in the elongate channels when the tongue section is inserted into the slot.

The stop section may include a pair of arms that extend transversely from the tongue section. Such arms may be formed perpendicularly relative to the tongue section.

BRIEF DESCRIPTION OF THE DRAWINGS

Other objects, features and advantages will occur from the following description of preferred embodiments and the accompanying drawings, in which.

Figures 1, 2:
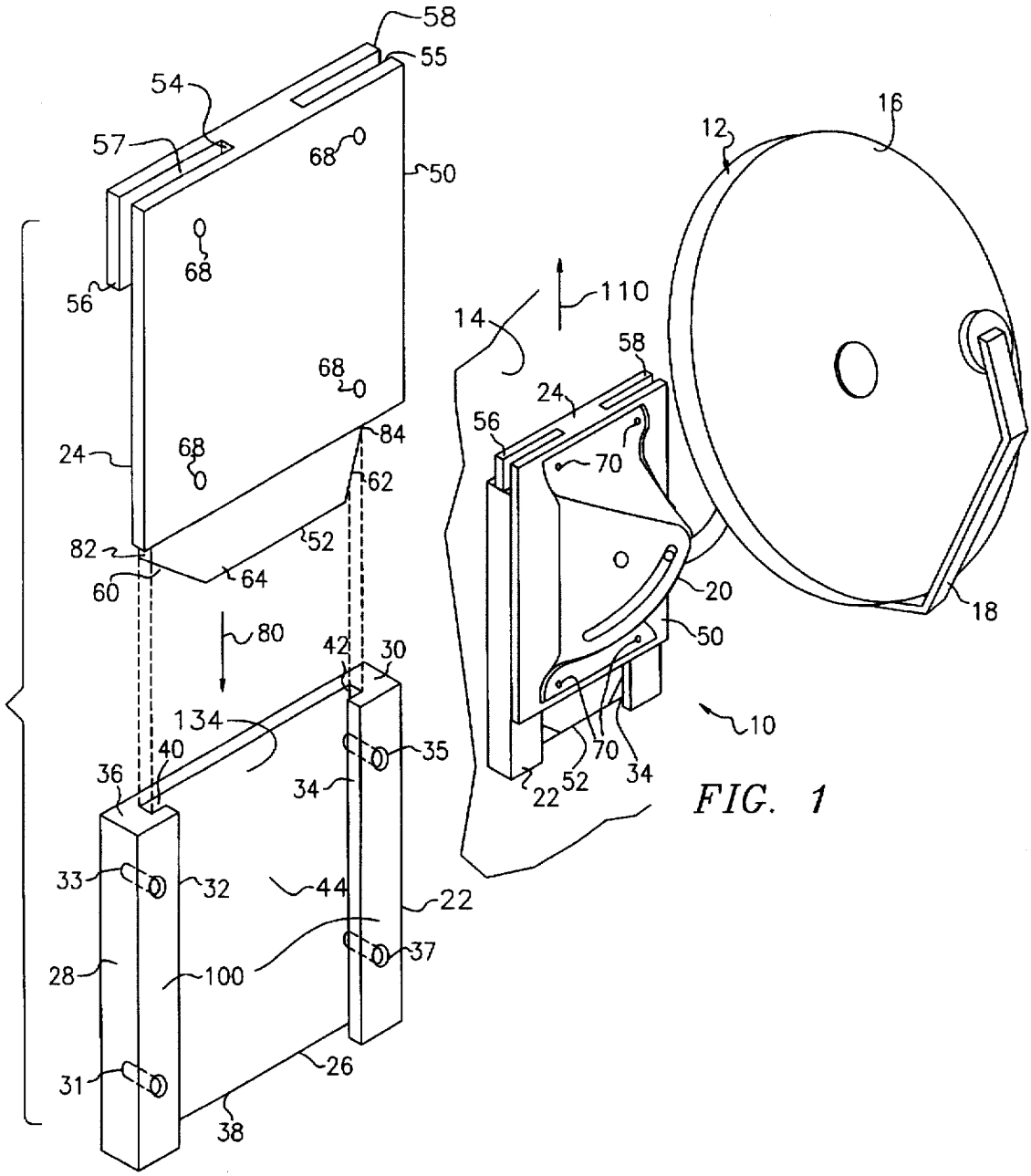
FIG. 1 is a perspective view of a preferred portable mounting apparatus according to this invention being used to support a receiving antenna, of the type employed in a satellite television system.
FIG. 2 is an exploded perspective view of the mounting apparatus.

There is shown in FIG. 1 a portable mounting apparatus 10 for securing a direct satellite system (DSS) receiving antenna 12 to a fixed or mobile supporting structure 14. Antenna 12 includes a number of standard components such as a dish 16, a support arm 18 and a base 20. These parts should be known to those skilled in the art and do not comprise a part of this invention. Apparatus 10 is particularly effective for supporting antennae of the type used in satellite television systems. However, it should be understood that the mounting apparatus may be used for portably mounting various other types of signal receiving antennae.

Apparatus 10 includes a bracket 22 that is permanently secured to structure 14 in the manner described more fully below. The mounting apparatus also features a portable mounting component 24 that is releasably interengaged with bracket 22. As shown in FIG. 2, bracket 22 comprises a unitary component that is constructed from a lightweight, yet durable metal or synthetic material. Aluminum, stainless steel and various metal alloys and molded plastics may be used. Bracket 22 includes a substantially flat rearward plate 26. A pair of side portions 28 and 30 extend forwardly from plate 26 and a pair of lips 32 and 34 extend perpendicularly inwardly from sides 28 and 30, respectively. As a result, bracket 22 defines an elongate vertical slot 134 that extends longitudinally from a top edge 36 to a bottom edge 38 of bracket 22. The slot includes a pair of longitudinal channel portions 40 and 42 that are defined by the side portions 28, 30 and inwardly turned lips 32, 34. The bracket also includes a central opening 44 into slot 134 that is defined by the space between lips 32 and 34. Opening 44 exposes the majority of slot 134 when mounting component 24 is disengaged from bracket 22. Pairs of holes 31, 33 and 35, 37 are formed in side sections 28 and 30, respectively. These holes are employed to mount bracket 22 to the supporting structure in a manner that will be described more fully below.

Figure 3:
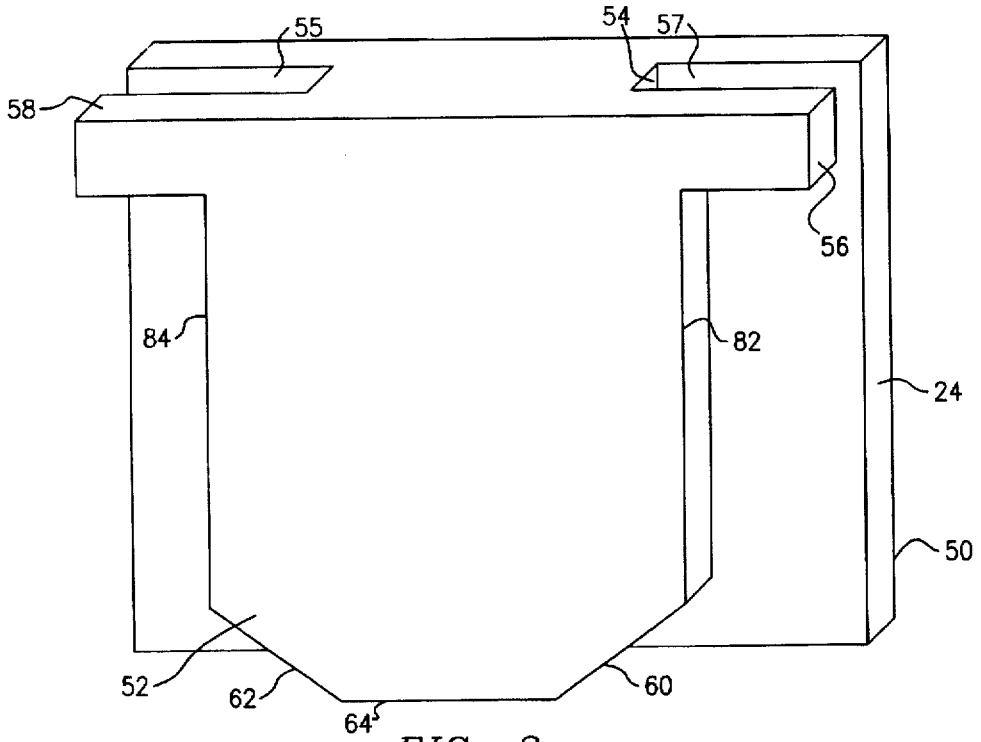
FIG. 3 is a rearward perspective view of the portable mounting component.

Portable mounting bracket 24, which is illustrated most clearly in FIGS. 2 and 3, includes a substantially flat outer plate section 50 and a substantially flat inner tongue section 52 that is unitarily interconnected to outer section 50 by an intermediate section 54. The tongue section is wider than intermediate section 54 but narrower than outer section 50. As a result, elongate passageways 55 and 57, FIGS. 2 and 3, are formed between outer plate section 50 an inner tongue section 52. A pair of elongate arms 56 and 58 are unitarily interconnected to tongue section 52 and extend perpendicularly from the tongue section proximate the top end of portable mounting component 24. The lower end of tongue section 52 includes a pair of angled corners 60 and 62 which are formed so that the lower edge 64 of the tongue section is narrower than the remainder of the tongue section.

As best illustrated in FIGS. 1 and 2, outer section 50 of mounting component 24 has a substantially flat, rectangular outer face. A plurality of holes 68 are formed in outer section 50. These holes are positioned such that they extend at least partially into intermediate section 54. As best shown in FIG. 1, conventional screws or bolts 70 are engaged with the bracket holes through complementary holes in base 20 of antenna 12. As a result, the antenna is secured to outer section 50 of portable mounting component 24.

Initially, bracket 22 is secured to the house, motor home, boat or other supporting structure. This is accomplished, for example, in the manner shown in FIG. 4. Bracket 22 is placed against the outer surface of support structure 14 such that holes 31, 33, 35 and 37, FIG. 2, in bracket 22 align with respective holes formed in the support structure. A backing component 92 having a corresponding number and pattern of holes is placed against the inside wall of structure 14. Component 92 and bracket 22 are arranged such that corresponding holes in the bracket, support structure and backing component are aligned. A bolt or other suitable fastening element 96 is then engaged with each set of aligned holes. As a result, bracket 22 is securely fastened to support structure 14. The fastening elements may comprise various types of conventional fasteners, including bolts, screws, rivets and other standard means. In alternative embodiments other techniques may be used to secure the bracket to the support structure.

Mounting component 24 is interengaged with bracket 22 by aligning tongue section 52 with bracket slot 134 in the manner shown in FIG. 2. The tongue section is slidably inserted in the direction of arrow 80 into slot 134 such that vertical side portion 82 of tongue 52 is received in channel 40 and vertical side portion 84 of the tongue section is received in channel 42. Lips 32 and 34 of bracket 22 are received in elongate passageways 57 and 55, respectively. Portable mounting component 24 is lowered in the direction of arrow 80 until perpendicular arms 56 and 58 engage the top edge 36 of bracket 22. The arms thereby serve as a stop and restrict further movement of the mounting component into the bracket. As a result, component 24 is releasably interengaged with bracket 22 in the manner depicted in FIGS. 1, 4 and 5. A portable mounting component 24 and attached antenna 12 are releasably interengaged with bracket 22 in the manner shown in FIGS. 1, 4 and 5. As previously described, the portable mounting component 24, with the antenna attached thereto, is slidably engaged with bracket 22 by inserting tongue section 52 into bracket slot 134. Transverse arms 56 and 58 of component 24 engage surface 88 (FIG. 2) located at the upper end of bracket 22 and serve to stop downward movement of the mounting component into the bracket.

Figure 4:
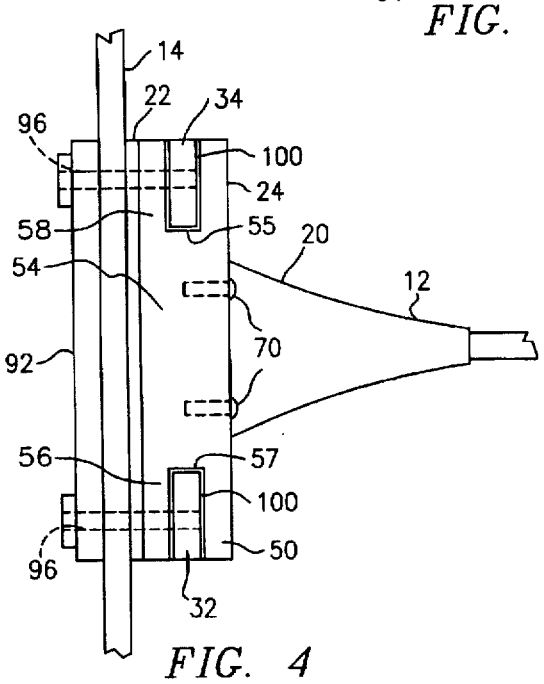
FIG. 4 is a plan view of the mounting apparatus of FIG. 1.
Figure 5:
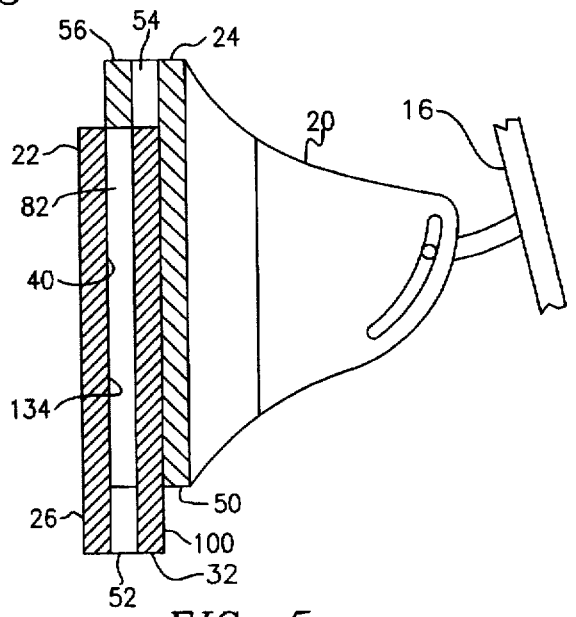
FIG. 5 is an elevational, cross sectional view of the mounting apparatus of FIG. 1.

Outer plate section 50 of component 24 is juxtaposed in a generally flush manner against the outer surface 100 defined by lips 32 and 34 of bracket 22. As shown in FIGS. 4 and 5, the inwardly turned lips are received in passageways 57 and 55, respectively, of component 24. As best illustrated in FIG. 5, edge portion 82 of tongue section 52 is received within channel 40 of slot 134. Similarly, on the opposite side of the apparatus, edge portion 84 is received within channel 42 (see FIG. 2). The interengaged mounting component and bracket are held securely in place against supporting structure 14. A conventional antenna cable, not shown, extends from antenna 12 and through the supporting structure to a television or other receiving apparatus. The precise manner of installing and interconnecting this receiving cable will be understood to those skilled in the art and does not comprise a part of this invention.

In alternative embodiments, tongue section 52, bracket plate 26, support structure 14 and backing component 92 may include corresponding holes that are aligned when the mounting component is inserted into the bracket. A bolt is inserted through these holes and secured in place by a wing nut or similar means attached inside of structure 14. This helps to prevent theft of bracket 22 from structure 14.

Mounting apparatus 10 holds the receiving antenna in place while satellite television reception is required. Subsequently, antenna 12 may be removed from support structure 14 so that the antenna can be stored, transported or relocated for improved reception. This is accomplished quickly, simply and conveniently. As shown in FIG. 1, mounting component 24 is slid upwardly in the direction of arrow 110 so that tongue section 52 is removed from bracket slot 134. The juxtaposed surfaces of the mounting component and bracket are flush and planar so that such slidable disengagement of the parts is achieved quickly and effortlessly.

Figure 6:
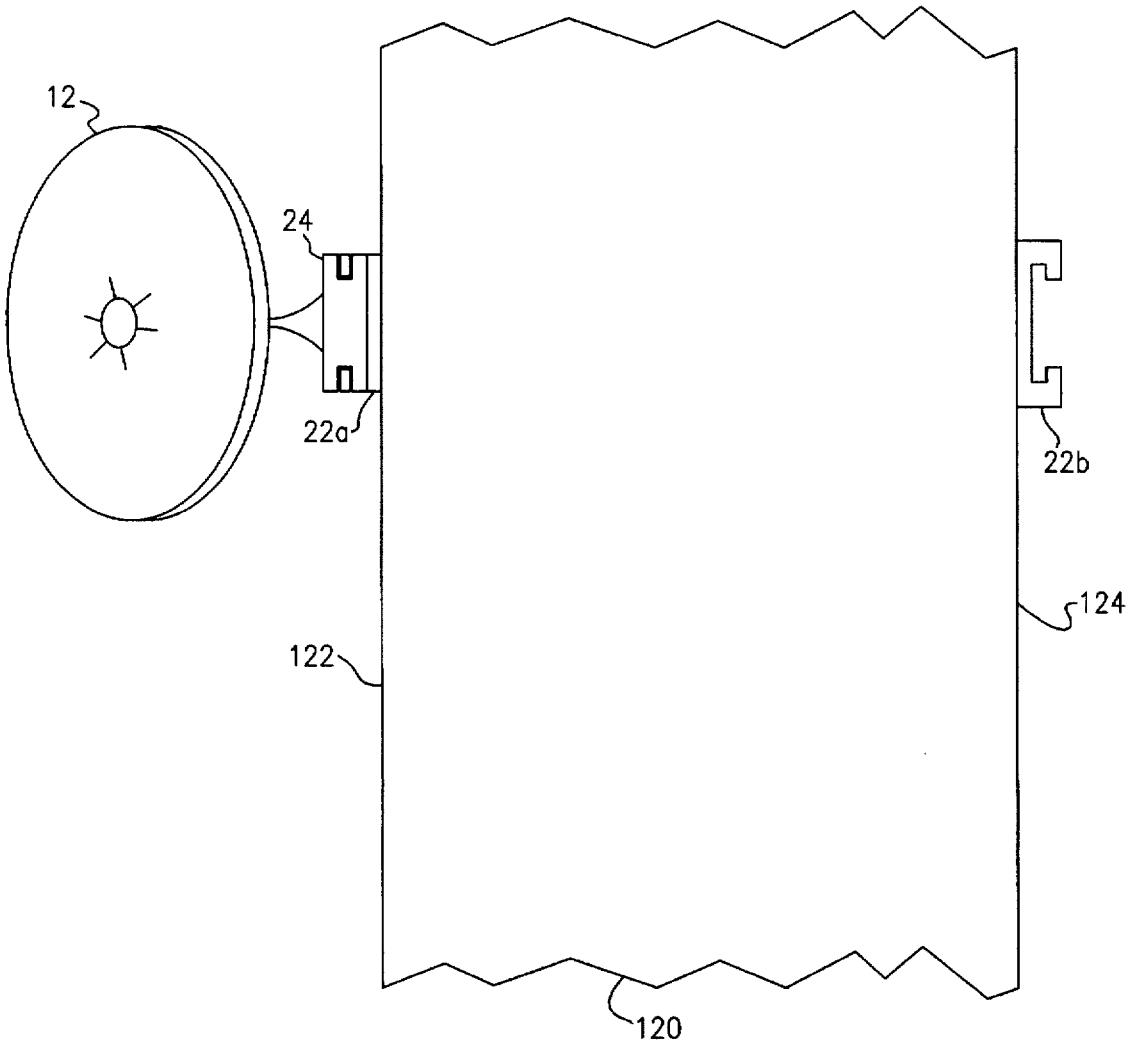
FIG. 6 is a plan view of a motor home carrying a pair of the mounting brackets, one of which is interengaged by the portable mounting component and an attached receiving antenna.

There is shown in FIG. 6 a motor home 120 having a pair of opposing sides 122 and 124. A pair mounting brackets 22 and **22*b*, according to this invention, are secured in the above-described manner to respective sides 122 and 124. This enables a portable mounting component 24 and an attached DSS antenna 12 to be releasably mounted to either side of the motor home. In FIG. 6, the antenna and portable mounting component are interengaged with the bracket 22*a* on the left hand side of vehicle 120. Such interengagement is accomplished in the manner previously described. As the vehicle is driven, component 24 and antenna 12 may be disengaged from bracket 22*a* by sliding the mounting component out of the bracket. Subsequently, when the vehicle is stopped and television reception is required, mounting component 24 and attached antenna 12 can be attached to a bracket 22*a*, 22*b* on either side of the vehicle. The side is selected which provides the best television reception. In either case, component 24 and antenna 12** are interengaged with the selected bracket in the manner previously described.

If desired, the mounting component and antenna may even remain attached to the selected bracket **22*a*, 22*b*** while the vehicle is in motion. The secure interengagement exhibited by the bracket and mounting component prevent accidental dislodged of the mounting component and damage to the antenna. The components remain securely interengaged due to the close tolerance fit between the flat tongue of the mounting component and the complementary flat slot of the mounting bracket.

Figure 7:
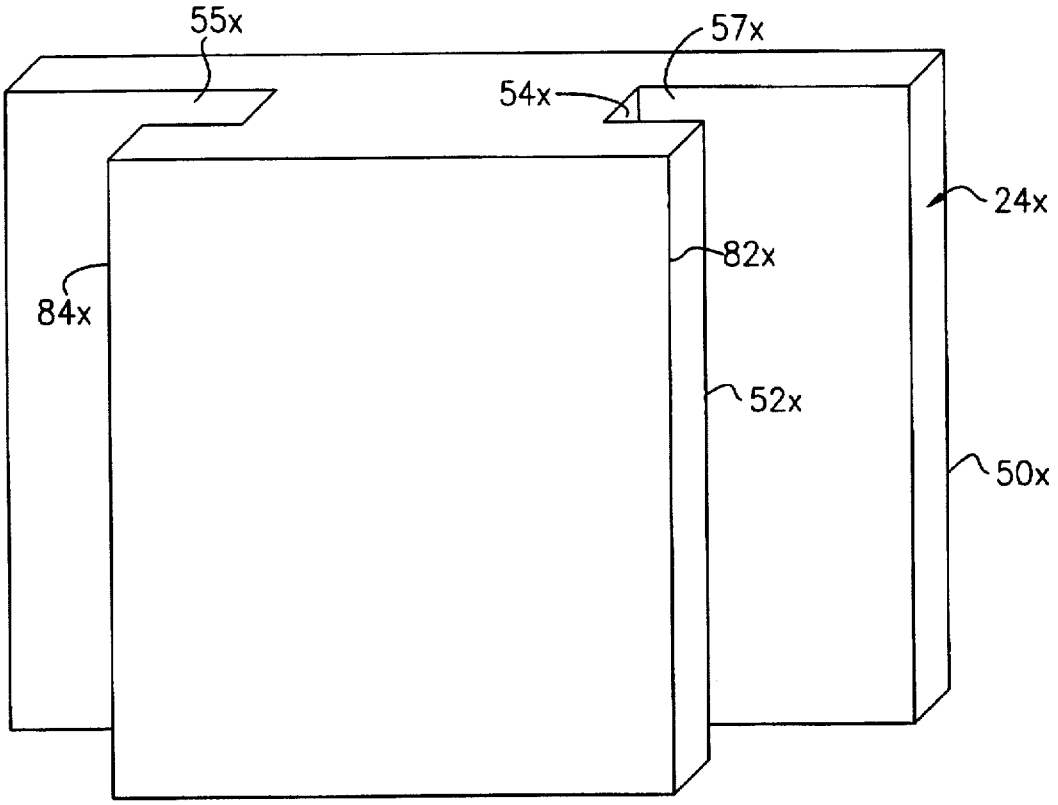
FIG. 7 is a rearward perspective view of an alternative mounting component.

An alternative preferred mounting component **24*x* is shown in FIG. 7. This mounting component again includes a flat outer plate section 50*x* and a tongue section 52*x* that is interconnected to section 50*x* by an intermediate section 54*x*. The tongue section includes a pair of vertical side edges 82*x* and 84*x* that define longitudinal slots 57*x* and 55*x*, respective. In this embodiment, tongue section 52*x* terminates at the lower end of front plate section 50*x* and does not extend below the front plate. As a result, the entire mounting component 24*x*** can be conveniently manufactured using conventional extrusion processes. This extrusion also eliminates the transverse arms extending from the top end of the tongue section.

Figure 8:
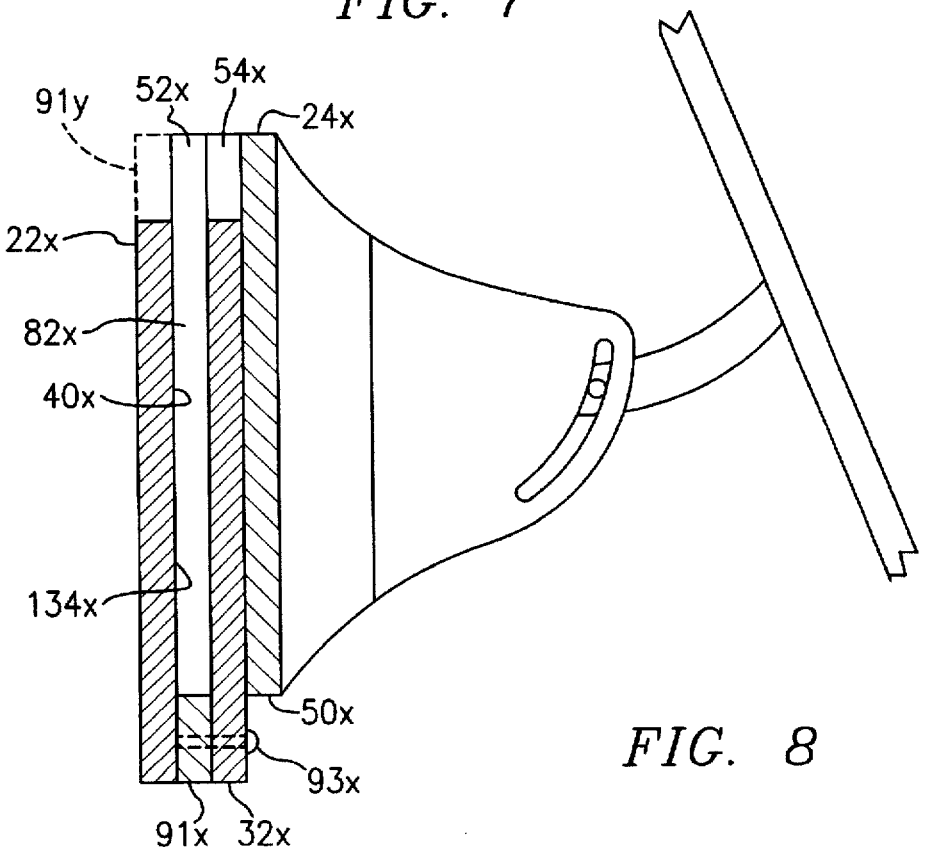
FIG. 8 is an elevational, cross sectional view of an alternative embodiment of this invention using the mounting component of FIG. 7 and a bracket having a transverse stop element.

Mounting component **24*x* is mounted to a mounting bracket 22*x* in the manner illustrated in FIG. 8. The mounting bracket is constructed almost identically to the bracket in the previously described embodiment. A stop element 91*x* is snugly fitted within slot 134*x* proximate the lower end of the slot. Stop 91*x* comprises a generally flat, elongate element, the ends of which are respectively received in the channel 40*x* and the opposite channel (not shown but see channels 40 and 42 in FIG. 2 of bracket 22*x*). Each of the lips, for example, lip 32*x* of bracket 22*x*, include a screw hole proximate the bottom end of the bracket that aligns with a complementary screw hole in stop 91*x*. A screw, rivet or similar fastener 93*x* is received in these aligned holes to secure stop 91*x* within bracket 22*x***.

Mounting component **24*x* is slidably engaged with mounting bracket 22*x* in a manner similar to that described for the previous embodiment. The vertical side edges of tongue section 52*x* are received in respective longitudinal channels of bracket 22*x*. For example, as shown in FIG. 8, vertical side 82*x* is received in longitudinal channel 40*x*. The lower end of tongue section 52*x* engages and is stopped by stop 91*x* so that the mounting component and attached antenna are held in the position shown in FIG. 8**. In all other respects, this embodiment is constructed and operates analogously to the previously described embodiment.

Figure 9:
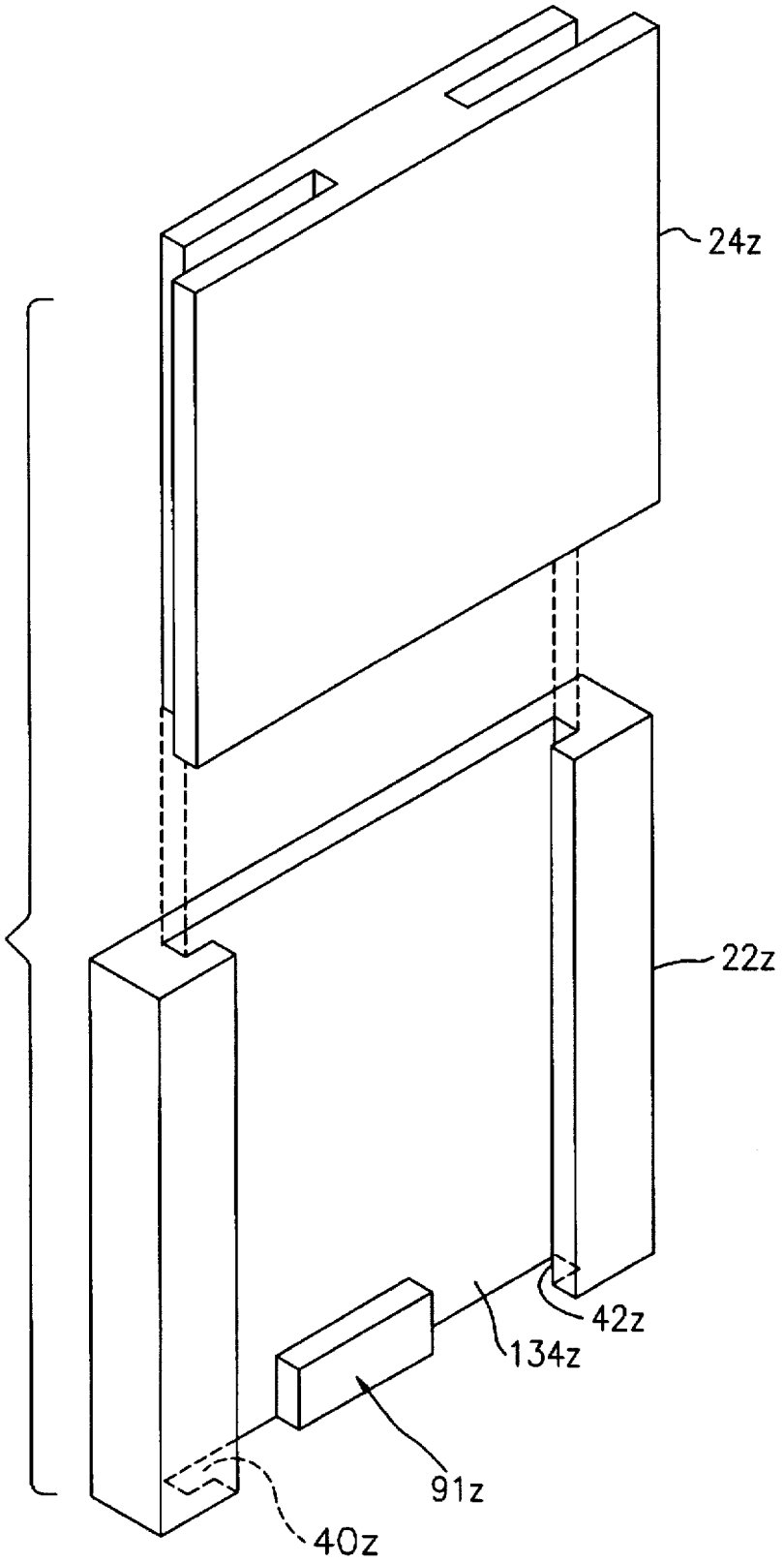
FIG. 9 is a perspective, exploded view of another alternative embodiment similar to that of FIG. 8 but using a shorter stop element.

An alternative stop **91*y* shown in phantom may be secured to the rearward end of tongue section 52*x* when the mounting component is engaged with the mounting bracket. Stop 91*y* engages the upper end of mounting bracket 22*x* in the manner shown. Still another alternative stop member 91*z* is illustrated in FIG. 9. In that version, the stop component is again received in the slot 134*z* of mounting bracket 22*z*. However, the stop 91*z* is not as long as stop 91*x*, FIGS. 7 and 8, and does not extend into the elongate channels 40*z* and 42*z* of bracket 22*z*. Stop 91*z* is secured to the rearward wall of bracket 22*z* by an appropriate bolt or adhesive or analogous means of attachment. This stop again serves to hold the mounting component 24 in place when it is inserted into mounting bracket 22*z*** in the manner previously described.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. An apparatus for mounting a receiving antenna to a separate and distinct supporting structure, said apparatus comprising:

a bracket that includes a substantially flat rearward plate, a pair of side portions that extend forwardly from said rearward plate and a pair of lips that extend inwardly from said side portions respectively to define an elongate, vertical slot in said bracket;

means for securing said bracket to the supporting structure; and a one-piece portable mounting component having a top end, a lower end, a substantially flat, outer plate section that carries means for attaching the receiving antenna to the outer section, a substantially flat inner tongue section and a vertically elongate intermediate section, which is narrower than and extends from said top end to said lower end of said mounting component and which unitarily interconnects said outer plate section and said inner tongue section, said intermediate section being narrower than said outer plate section and said inner tongue section such that said intermediate section, said outer plate section and said inner tongue section define a pair of elongate, vertical passageways through said mounting bracket, the length of each said passageway being substantially greater than the width of said passageway, said tongue section being slidably inserted in said slot and each said lip being slidably received by and interengaged with a respective said passageway such that said mounting component is releasably interengaged with said bracket.

2. The apparatus of claim 1 in which said slot and said tongue section include elongate, substantially flat configurations.

3. The apparatus of claim 1 in which said tongue section includes a leading end that has angled corners which facilitate insertion of said tongue section into said slot.

4. The apparatus of claim 1 in which said means for securing include at least one hole formed in said bracket and a complementary fastening element that is engageable with each said hole.

5. The apparatus of claim 1 in which said means for securing include a backing component that is engaged with the supporting structure such that the supporting structure is disposed between said bracket and said backing component, said means for securing further including at least one pair of complementary aligned holes formed in said bracket and said backing member and a fastening means extending through said support structure and being interengaged with each said pair of aligned holes.

6. The apparatus of claim 1 in which said outer section comprises a substantially flat plate.

7. The apparatus of claim 1 in which said slot includes a pair of elongate channels, said tongue section having a pair of generally vertical side portions that are respectively received in said elongate channels when said tongue section is inserted into said slot.

8. The apparatus of claim 1 in which said stop section includes a pair of arms that extend transversely from said tongue section.

9. The apparatus of claim 8 in which said arms extend perpendicularly from said tongue section.

10. The apparatus of claim 1 in which said intermediate section and said outer plate section are directly joined at an elongate junction that extends fully along an inside surface of said outer plate section from said top end to said lower end of said mounting component.

11. The apparatus of claim 1 in which said intermediate section and said passageways include respective lengths that are greater than the distance between said outer plate section and said inner tongue section.

12. The apparatus of claim 1 in which said slot includes an entrance formed at an upper end of said bracket.

13. The apparatus of claim 1 in which said bracket includes an opening formed therethrough into said slot, which opening accommodates said intermediate section of said mounting component when said tongue is inserted into said slot.

14. The apparatus of claim 1 further including a stop attached to said bracket and being received in said slot, said stop being engaged with said tongue section to limit the extent to which the tongue section is insertible in said slot.

15. A portable receiving antenna apparatus comprising:

a receiving antenna;

a bracket that includes a substantially flat rearward plate, a pair of side portions that extend forwardly from said rearward plate and a pair of lips that extend inwardly from said side portions respectively to define an elongate, vertical slot in said bracket;

means for securing said bracket to the supporting structure;

a one-piece portable mounting component having a top end, a lower end, a substantially flat, outer plate section that carries means for attaching the receiving antenna to the outer section, a substantially flat inner tongue section and a vertically elongate intermediate section, which is narrower than and extends from said top end to said lower end of said mounting component and which unitarily interconnects said outer plate section and said inner tongue section, said intermediate section being narrower than said outer plate section and said inner tongue section such that said intermediate section, said outer plate section and said inner tongue section define a pair of elongate, vertical passageways through said mounting bracket, the length of each said passageway being substantially greater than the width of said passageway, said tongue section being slidably inserted in said slot and each said lip being slidably received by and interengaged with a respective said passageway such that said mounting component is releasably interengaged with said bracket.

16. The apparatus of claim 15 further including a stop attached to said bracket and being received in said slot, said stop being engaged with said tongue section to limit the extent to which the tongue section is insertible in said slot.

* * * * *